US008292695B2

(12) United States Patent
Flores et al.

(10) Patent No.: US 8,292,695 B2
(45) Date of Patent: Oct. 23, 2012

(54) MACHINE FOR CREATING NON-CYLINDRICAL BORE SURFACES

(75) Inventors: Gerhard Flores, Ostfildern (DE); Ulrich Klink, Neuffen (DE); Klaus Litty, Kernen (DE); Andreas Dolla, Esslingen (DE)

(73) Assignee: Gehring Technologies GmbH, Ostfildern (DE)

( * ) Notice: Subject to any disclaimer, the term of this patent is extended or adjusted under 35 U.S.C. 154(b) by 367 days.

(21) Appl. No.: 12/665,112

(22) PCT Filed: Jul. 30, 2008

(86) PCT No.: PCT/EP2008/006265

§ 371 (c)(1),
(2), (4) Date: Dec. 17, 2009

(87) PCT Pub. No.: WO2009/018949

PCT Pub. Date: Feb. 12, 2009

(65) Prior Publication Data

US 2010/0197199 A1 Aug. 5, 2010

(30) Foreign Application Priority Data

Aug. 4, 2007 (DE) ..... 10 2007 038 123

(51) Int. Cl.
*B24B 49/00* (2012.01)

(52) U.S. Cl. ..... 451/27; 451/155

(58) Field of Classification Search ..... 451/27, 451/51, 121, 150, 155, 919
See application file for complete search history.

(56) References Cited

U.S. PATENT DOCUMENTS 2,411,851 A * 12/1946 Caserta ..... 451/154
3,496,678 A * 2/1970 Engle ..... 451/124
3,884,789 A * 5/1975 Czubak ..... 204/224 R
3,922,819 A * 12/1975 Bender et al. ..... 451/239
4,346,534 A * 8/1982 Czubak ..... 451/125
4,945,685 A * 8/1990 Kajitani et al. ..... 451/27
5,174,695 A 12/1992 Bathen et al.
5,269,103 A * 12/1993 Nagel et al. ..... 451/8

(Continued)

FOREIGN PATENT DOCUMENTS

DE 3828854 A1 3/1990

(Continued)

OTHER PUBLICATIONS

Klaus Lonne; Das Goetze Zylinderverzugmellsystem and Möglichkeiten zur Reduzierung der Zylinderverzuge; Publication No. 893610-12/88, published by the Goetze Company, 1988.

(Continued)

*Primary Examiner* — Maurina Rachuba
(74) *Attorney, Agent, or Firm* — Gudrun E. Huckett

(57) ABSTRACT

The invention relates to a machine for creating non-cylindrical bore surfaces having a machine spindle (5), to which a machining tool (2-06, 3-04) can be connected, onto which a feed movement is transferred via a feed means (1-10). A direct axially parallel acting linear drive (1-06) is provided in the tool fitting unit (1) associated with the machine spindle (5) for fine feeding, the feed movement of which overlaps the first mentioned feed movement, and the actuating means (1-05) of which acts upon a feed (1-03) that is disposed together with the machining tool (2-05, 3-04) and the means for deflection (1-031, 1-032) of the feed movement in a tool unit (2, 3) that can be exchanged on the tool fitting unit (1).

23 Claims, 10 Drawing Sheets

U.S. PATENT DOCUMENTS

| | | | | |
|---|---|---|---|---|
| 5,681,210 | A * | 10/1997 | Lin et al. | 451/157 |
| 6,179,700 | B1 * | 1/2001 | Lalone et al. | 451/464 |
| 6,586,862 | B1 * | 7/2003 | Cselle | 310/328 |
| 6,655,883 | B2 | 12/2003 | Maar | |
| 6,960,121 | B2 * | 11/2005 | Klink et al. | 451/51 |
| 2003/0120374 | A1 | 6/2003 | Klink et al. | |
| 2005/0130560 | A1 * | 6/2005 | Klink et al. | 451/5 |

FOREIGN PATENT DOCUMENTS

| | | | |
|---|---|---|---|
| DE | 4007121 | A1 | 9/1990 |
| DE | 19925193 | A1 | 10/2000 |
| EP | 1169154 | A1 | 1/2002 |
| EP | 1321229 | A1 | 6/2003 |
| EP | 1790435 | A | 5/2007 |
| JP | 64-078755 | A | 3/1989 |
| JP | 5-4163 | A | 1/1993 |
| JP | 7-285003 | A | 10/1995 |
| JP | 8-197373 | A | 8/1996 |
| JP | 11-10414 | A | 1/1999 |
| JP | 2000281485 | A1 | 10/2000 |
| JP | 2003-512188 | A | 4/2003 |

OTHER PUBLICATIONS

J. Schmid: Optimiertes Honverfahren für Gusseisen-Laufflachen; in Zylinderlaufbahn, Kolben, Pleuel Innovative Systeme im Vergleich; VDI-Berichte No. 1906, 2006; pp. 217-235.

* cited by examiner

MACHINE FOR CREATING NON-CYLINDRICAL BORE SURFACES

BACKGROUND OF THE INVENTION

The invention concerns a machine, preferably a honing machine or a drilling machine, for producing non-cylindrical bore surfaces with a machine spindle that is reciprocatingly movable and driven in rotation, to which at least one machining tool is connectable, onto which by feed means a feed movement is transmitted, that, after a deflection, feeds the machining tool radially against the bore surface to be machined and in which the feed movement of the aforementioned feed means is superposed by a feed movement of a means for fine feed.

This concerns a machine for machining bores that under functional conditions locally deform differently by known amounts. The deformations are changes relative to a desired, essentially ideal cylindrical shape. They are produced by tension created by mounting, thermal effects, and dynamic forces (compare K. Löhne, Das GOETZE Zylinderverzugsmeßsystem und Möglichkeiten zur Reduzierung der Zylinderverzüge (translation: The GOETZE cylinder distortion measuring system and possibilities for reducing cylinder distortions), publication No. 89 36 10 - 12/88 of the Goetze Company; as well as J. Schmid, Optimiertes Honverfahren für Gusseisen-Laufflächen (translation: Optimized honing method for cast iron running surfaces), VDI—Berichte No. 106, pp. 217-235) Such bores are therefore provided with a non-cylindrical bore surface that then assumes the desired cylindrical shape as a result of the deformations generated in the operating state. Bores with bore surfaces machined in this way provide improved operating conditions, for example, reduced friction and higher gas tightness in an internal combustion engine by means of reduced pretension of the piston rings. This method for producing a non-cylindrical bore surface is also referred to as "shape honing".

FIG. 1 shows in spatial illustration a bore surface machined in this way with a local depression or expansion 11 and a local constriction 22. This shape is the nominal shape that is to be produced by machining and that, when stressed in the operating state, deforms precisely to a cylindrical bore. Such given contours that deviate from a cylindrical shape are defined as inverted deviations from a cylindrical ideal shape and, for example, are determined e.g. by finite element calculations or experimentally.

A method for producing such bore surfaces deviating from the cylindrical shape is disclosed, for example, in EP 1 321 229 A1 and DE 4 007 121 A. Also, Japanese publication JP 2000-291487 A discloses a honing tool with piezoelectric feed elements between the tool body and the honing stones (compare FIGS. 6 and 7, reference numeral 22, as well as paragraphs [35 and 36] of the description). In EP 1 169 154 B1 (=WO 00/62962) a piezoelectric adjusting mechanism is described which is arranged in the tool body between radially opposed cutting edges. In EP 1 790 435 A1 a tool is disclosed with a base feed for complete machining of the bore surface and an additional fine feed for generating shape deviations deviating from a cylindrical shape; the latter is formed by a piezoelectric element arranged between cutter bar and support bar.

For further explaining the object of the invention, reference is being had to FIG. 2: This Figure shows a cross-section of a bore surface machined in such a way that has a depression 11 defined by a shape change ds within an angle dphi. In order to be able to achieve effective functional improvements in bore surfaces of this kind, cylindrical distortions must be generatable by Fourier coefficients up the eighth order. Moreover, with regard to manufacturing technological reasons (reduction of the machining time) the rotary speed of the tool should be selected to be as high as possible. This requires feed dynamics that must be able to thus generate quickly the desired radial adjustment of the cutting means (for example, a honing stone or drill bit cutting edge). As a function of the employed machining method, for example, honing or fine drilling, the radial feed speeds must be defined that result from the required cutting speed that is based on the cutting means.

The object of the present invention resides thus in providing a machine for producing a non-cylindrical bore surface which machine, with respect to its configuration, is simpler and thus less expensive than the prior art machines and has improved feed dynamics.

The aforementioned object is solved in that the means for fine feed is arranged in a tool receiving unit correlated with the machine spindle and is embodied by an axis-parallel acting linear drive, whose actuator acts on a feed rod that is arranged with the machining tool and the means for deflection of the feed movement in a tool unit that is exchangeably connectable to the tool receiving unit. The invention concerns moreover different advantageous further embodiments that are defined in the dependent claims.

According to the invention that concerns honing as well as the aforementioned fine drilling, it is provided for solving the above-mentioned object that the tool receiving unit, that contains the means for fine feed in the form of an axis-parallel directly acting linear drive, is embodied as a non-exchangeable part of the machine spindle and thus of the machine, be it a honing or a fine drilling machine, on which the tool unit—depending on the required tool—is arranged to be exchangeable. The device for fine feed, in this connection preferably the linear drive, therefore, contrary to the prior art, is not to be mounted separately for each tool in the tool unit but is to be provided on the machine only once, namely in the tool receiving unit to be arranged thereat to which different tool units can be connected that must contain the actual machining tools and the deflection means for the feed action but not the—relatively expensive—means for the fine feed action.

In a honing machine that generates by up and down movement with simultaneous rotation of the honing stones in a conventional way a cross-grinding pattern, the observation applies, of course, also analogously to the movement component in the direction of the axis of a bore. This movement component is realized however less quickly than that along the circumference so that the improvement of the feed dynamics that is achieved for the radial feed action leads to an improved result in superposition with the axial component.

In addition to this fine adjustment the known adjustability as a coarse adjustment is still provided.

None of the aforementioned publications shows a tool that by a machine-side tool receptacle, that forms an independent assembly of the machine, with which a dynamic feed action is provided and in which are integrated highly dynamically operating, preferably linearly working, finefeed drives, which temporarily can effect independently from one another the feed movements preferably of several cutting means by means of several axis-parallel feed rods. The tools that are disclosed in the prior publications operate with dynamic fine feed action within the tool with a spacing relative to the cutting means that is as minimal as possible. Therefore, they have only a minimal height and thus also a minimal feed stoke available. Therefore, at such a location it is only possible to mount means for fine feed of a minimal height and therefore with relatively small feed stroke.

According to the invention, one or several axis-parallel acting linear drives can be provided for independent feeding of machining tools or cutting means (honing stones or drill bit cutting edges). The linear drives that are embodied, for example, as piezoelectric linear actuators are activated by electrical control and generate an axial movement of a plunger with a certain force and speed which plunger acts onto the feed rod for radial feed of the cutting means of the machining tools.

For example, it can be realized that for a radial feed stroke of 20 μm within an angle dphi of appr. 25°, a bore diameter of appr. 80 mm, and a rotary speed of 400 l/min. the time for expanding and retrieving a cutting means is appr. 10 ms.

The invention thus provides that the tool unit and the tool receptacle including the linear drive are constructively separated and that the linear drive for the dynamic feed (fine feed) is correlated with the tool receiving unit and thus with the machine or an assembly that is independent of the exchangeable tool unit. On the lower end face of the tool receiving unit the tool unit is exchangeably arranged. The tool unit contains exclusively only components for deflecting the stroke movements generated at the machine into feed movements for the machining tools and optionally the independent feed movements for the guide bars as well as the machining tools and optionally the guide bars themselves.

Supra, it has been stated that the tool receiving unit is provided as a part of the machine. However, this does not preclude that it is realized and mountable as an independent unit.

In the tool body of the tool unit the feed rods are coaxial to the plunger or the plungers of the linear drives of the tool receiving unit. The plungers exert a force that is axis-parallel to the center onto the aligned feed rods. At the end faces of the plungers and the feed rods the feed force is transmitted onto the radially movable machining tools. The end faces are designed such that no shearing forces acting in a normal direction are transmitted. At the lower end of the feed rods wedge surfaces are machined that deflect the axial movement into a radial feed movement.

With the arrangement and design in accordance with the invention of tool receiving unit and tool unit it is possible to produce inverted functional shapes. As a result of the dynamic fine feed of the machining tools, the desired nominal shape can be achieved at high cutting speeds and small shape change segments with great radial shape changes at high precision of a few micrometers.

Positioning of the cutting means with a coarse feed improves the dynamic feed behavior because the fine feed must operate only in the range of the local shape changes. Since the tool receiving unit with the fine feed integrated therein is constructively separated from the tool unit, it is only necessary to arrange in the tool unit exclusively simple mechanically actuated tools without their own feed drives. The tool unit is exchangeable for various machining tasks.

Moreover, the cooling lubricant material has only direct contact with the tool but not with the tool receiving unit in which the means for fine feed are arranged. The linear drives are thus protected from the damaging effect of aggressive liquids.

BRIEF DESCRIPTION OF THE DRAWINGS

Embodiments of the invention and their advantageous modifications will be explained in more detail in the following with reference to the attached drawings. It is shown in.

DESCRIPTION OF PREFERRED EMBODIMENTS

Figure 1:
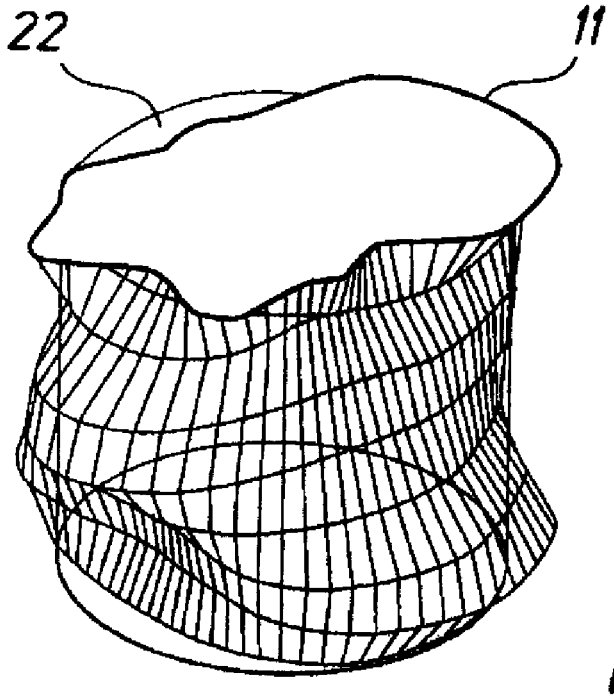
FIG. 1 a bore surface with a local expansion.
Figure 2:
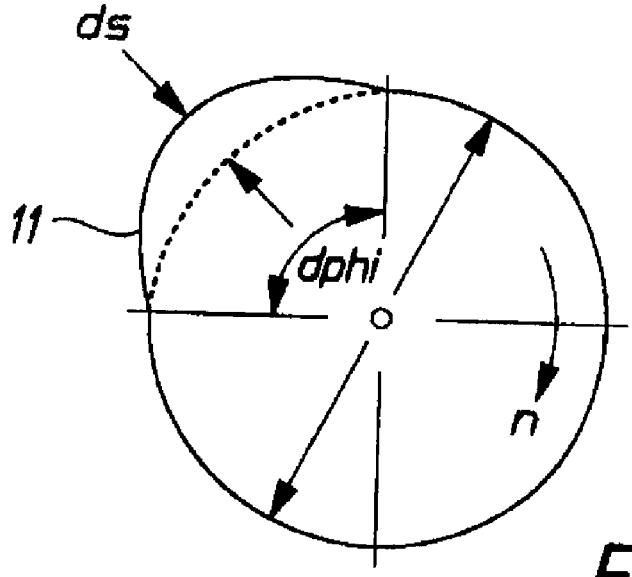
FIG. 2 the cross-section of a bore surface according to FIG. 1.
Figure 3:
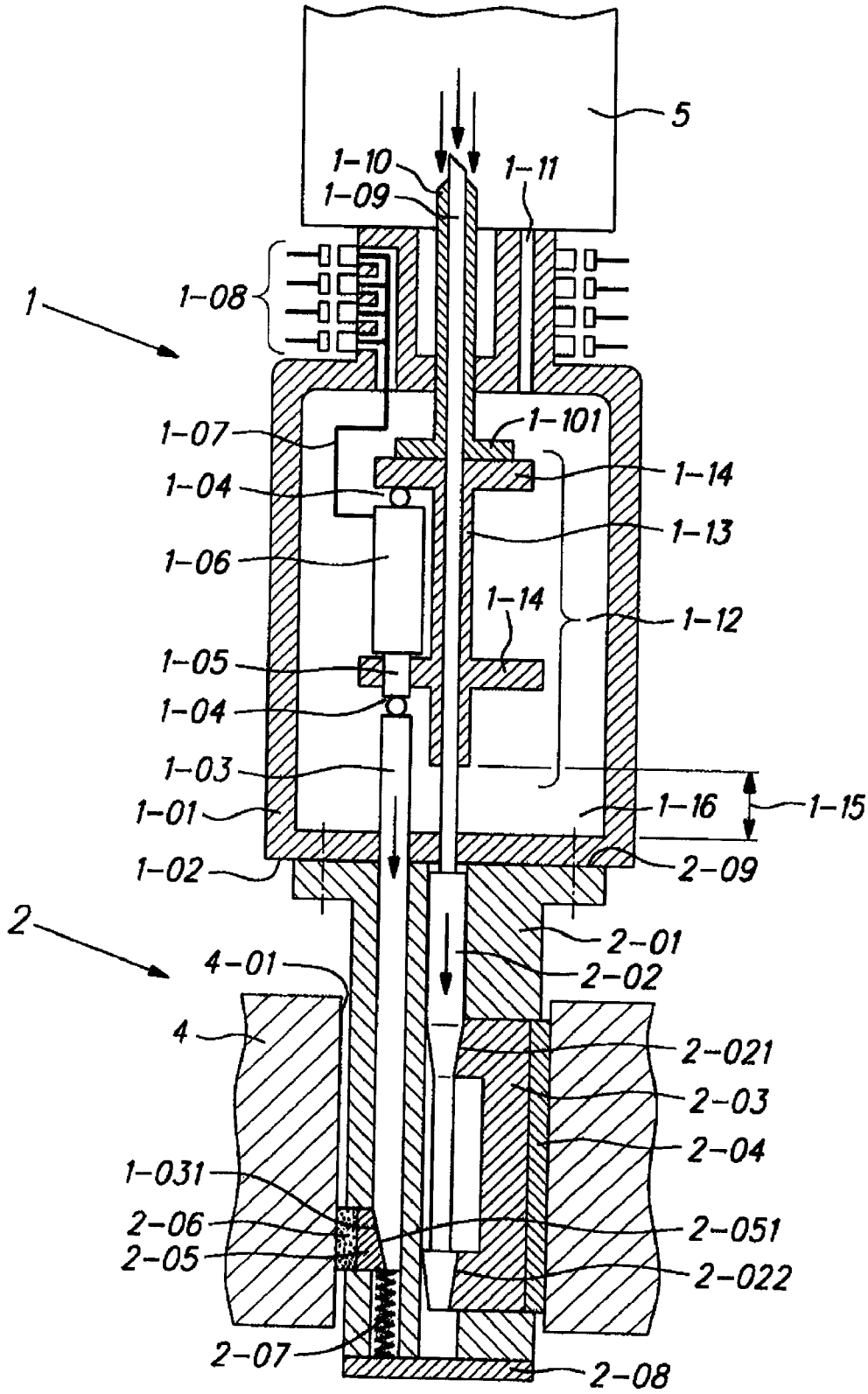
FIG. 3 a first embodiment.
Figure 4A:
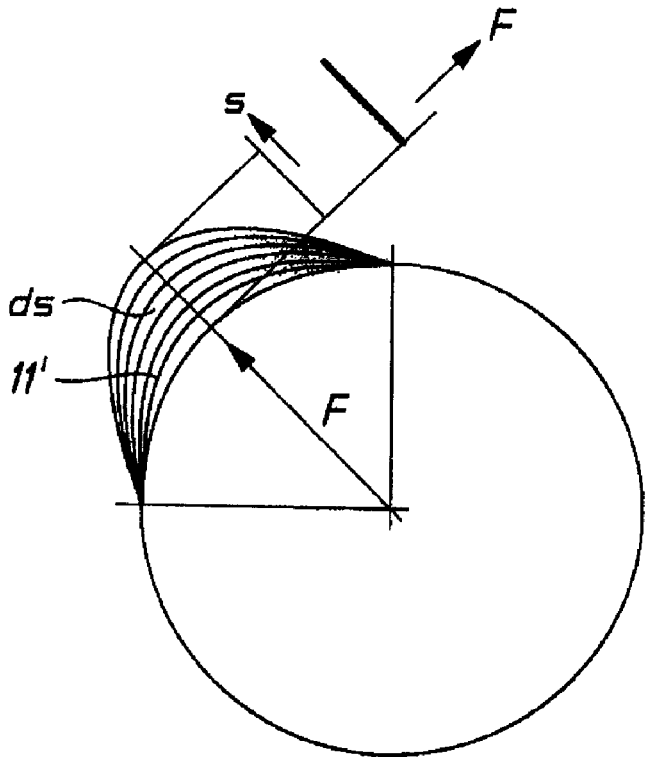
FIG. 4*a* and FIG. 4*b* explanations of the function of the linear drive 1-06 according to FIG. 3.
Figure 4B:
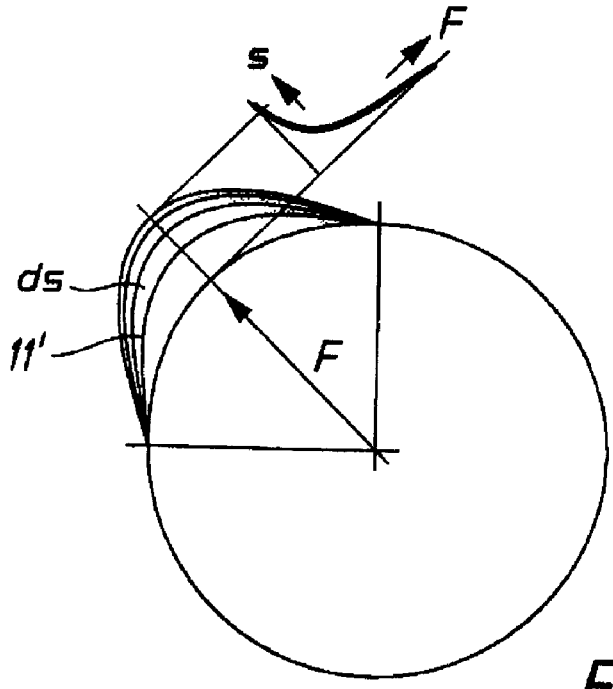

The first embodiment according to FIGS. 3, 4*a*, and 4*b* shows as a part of a honing machine a tool receiving unit 1 for fine feed. It comprises linear drives 1-06 that act directly axis-parallel and may be arranged circumferentially (compare also FIG. 5*a*), of which in FIG. 3 only one is illustrated. On the tool receiving unit 1 the tool unit 2 is exchangeably arranged that comprises the actual machining tool, i.e., the honing stone 2-05 provided with the cutting means coating 2-06, as well as the guide bar 2-04 or guide bars, radially oppositely illustrated, for supporting the honing stone or the honing stones as well as the assigned feed rods 1-03 (for the honing stone) and 2-02 (for the guide bar). The tool unit 2 rests with its end face 2-09 against the end face 1-02 of the tool receiving unit. Both are connected to one another with suitable means 1-16, for example, screws. The tool unit 2 is of a simple configuration. It can be exchanged simply and in an easy way without having to exchange also the tool receiving unit 1 in which the axis-parallel directly acting means for fine feed, i.e., the linear drive 1-06, are arranged. When employing an—expensive—piezoelectric linear feed element, this provides a significant cost reduction.

When in the following in the description of the embodiments a directly acting linear drive is mentioned, this means that initially no stroke enlargements by gear-like transmissions, which are however possible, are taken into account.

The tool receiving unit 1 and the tool unit 2 rest with their end faces 1-02 and 2-09 against one another and are easily detachably from one another. The means 1-16 for this purpose are well known in the prior art and therefore only schematically indicated.

The tool receiving unit 1 is located in the housing 1-01 that is connected with its upper end to the machine spindle 5. As is conventional for honing, the machine transmits rotary movement, lifting movement, and feed movement onto the tool receiving unit 1. The feed action is realized in a two-fold mode by means of the feed rod 1-09 for the guide bar 2-04 and by means of the feed tube 1-10 for the coarse feed of the honing stone 2-05. The feed rod 1-09 is guided in the feed tube 1-10. The feed tube 1-10 is connected to the support 1-13. Both the feed rod 1-09 and the feed tube 1-10 are independent from one another. Both are moved downwardly for feed action in the axial direction—independent from one another—by the control unit of the honing or fine drilling machine on which the machine spindle 5 is arranged.

The lower end of the feed rod 1-10 is connected with the upper flange 1-14 of the support 1-13. Between the two flanges 1-14 of the support 1-13 the linear drive 1-06 provides a fine feed action of the honing stone 2-05 is arranged that is acting directly in the axial direction. It is moved by the bottom side of the upper one of the two flanges 1-14 downwardly and actuates as an actuator the plunger 1-05. The linear drive 1-06 is supplied by the electrical lines 1-07 with drive power and control signals. The supply of energy signals and control signals is realized by sliprings 1-08. Contactless inductive telemetric transmission systems may also be used. The linear direct drive 1-06 operates, for example, piezoelectrically with a stroke of up to 250 μm. These piezo actuators are designed to be safe with respect to centrifugal force. Electromagnetic drives according to the principle of plunger coils or magnetostriction, electro-rheological or magneto-rheological actuators are possible also.

The means that as a whole are referenced by 1-12 for fine feed action are formed (as shown) by at least one linear drive 1-06. However, as already mentioned supra with regard to FIG. 5*a*, about the axis of the system between the flanges 1-14 further linear drives may be arranged so that each honing stone may have assigned to it a separate linear drive.

The housing 1-01 has a sealing air bore 1-11 through which a minimal overpressure (generated elsewhere) is maintained in the housing and therefore penetration of liquid because of externally existing leakage is prevented.

The linear drive 1-06, as already mentioned, is provided at its lower end with a plunger 1-05 as an actuator whose linear movement is transmitted onto the feed rod 1-03. In this way, the fine feed action effected by the linear drive 1-06 is superposed onto the coarse feed action that is preset on the machine side by the feed rod 1-10.

The installation of the linear direct drives 1-06 is realized so as to be free of transverse forces. The force transmissions 1-04 free of play and transverse forces are indicated here only symbolically as spheres and can be embodied as joints in the form of planar or curved glide surfaces or in other ways. They must transmit tension and pressure without play and moreover must have rotatory degrees of freedom so that the feed rod 1-03 that rests with its wedge-shaped feed surface 1-031 at its lower end against the feed surface 1-031 of the honing stone 2-05 that is also wedge-shaped can align itself in complete areal contact on the honing stone. It must therefore be able, if needed, to tilt slightly at the force transmission 1-04 from the plunger 1-05. This it can do only when the force transmission 1-04 does not transmit any transverse forces. Also, a compensation of a minimal axial displacement between plunger 1-05 and feed rod 1-03 is possible.

A linear drive that is formed by a piezoelectric element can move the feed rod with great force downwardly. The linear drive 1-06 has available only a minimal force for a return movement. The return is therefore assisted by the restoring spring 2-07 or is applied entirely by it. It is also possible to provide two linear drives of which one serves to provide the feed action, the other the restoring action.

In the tool body 2-01 there is the feed rod 2-02 provided with two cone-shaped feed surfaces onto which acts from above the feed rod 1-09. The conical feed surfaces 2-021 and 2-022 interact with wedge-shaped feed surfaces on the support bar 2-03 on which immediately radially adjoining a guide bar 2-04 is arranged so that in this way the axial movement of the feed rod 1-09 is converted (deflected) into a radial movement of the guide bar(s). Along the circumference of the workpiece 4 several, for example, four, guide bars 2-04 may be arranged between which along the circumference four feed rods 1-03 may be arranged. With a sufficient bending-resistant embodiment of the tool receiving unit and tool unit, guide bars can be eliminated or must not be actuated in the control sequence.

For smaller bores, a coaxial transmission of the feed forces is however not possible constructively. In this case, mechanical force deflections, for example, bending joints, are required that transmit the feed force onto the feed rods that are positioned at a smaller radial spacing.

In accordance with the arrangement of the linear drive 1-06 (or the linear drives) in the tool receiving unit 1 there is (or are) the feed rod 1-03 (or feed rods) in a linear extension coaxial to the axis. At the end of the feed rod 1-03 there is the wedge-shaped feed surface 1-031. Against this feed surface 1-031 the honing stone 2-05 rests with the feed surface 2-051 that is also wedge-shaped. Immediately on the exterior side of the honing stones 2-05 a cutting means coating 2-06 is applied. Depending on the control of the linear direct drive 1-06, a fine feed action is effected on the honing stone 2-05 in addition to the coarse feed action that is effected by the feed tube 1-10. Both feed movements are acting in superposition on the feed rod 1-03 and are converted or deflected (compare illustrated arrow) in the tool unit 2 into a radial feed movement of the cutting means coating 2-06 against the bore surface 4-01 of a workpiece 4. The restoring spring 2-07 assists the force transmission 1-04, free of play and transverse forces, in the feed train between linear drive 1-06 and feed rod 1-03 upon relief (restoring action) of the feed train. For a fast transmission of the feed movement the feed rod 1-03 can also be made of a material of reduced density so that by reduced mass inertia the movement of the linear drive can be transmitted even more safely in a delay-free way. When designing the arrangement for pressure force transmission, the restoring spring 2-07 is to be designed such that upon relief of the honing stone the spring force generates an upwardly oriented acceleration that is at least as great as the upwardly directed acceleration of the plunger 2-05 so that an axial form fit between feed rod and plunger is ensured.

The feed rod 2-02 is designed such that it defines an angle with the slanted surface 1-31 of the feed rod 1-03 which angle is outside of the range of self-locking action.

The feed rod 1-09 is moved at the machine axially downwardly. It impinges on the feed rod 2-02 by means of which the guide bars 2-04 are forced against the bore surface 4-01. On the other hand, the feed tube 1-10 moves the support 1-13 of the means 1-12 for fine feed and through them the feed rods 1-03 axially downwardly and forces thus the cutting means coating 2-06 of the honing stones 2-05 against the bore surface 4-01 of the workpiece 4. Beginning with this position, the linear drive 1-06 is controlled about the circumference of the bore, i.e., as a function of the angle dphi and as a function of the vertical position of the bore. In this connection, each honing stone is correlated in any position with a shape change to be achieved at this location.

By arrangement of the honing stones in different vertical positions, in particular by arranging short honing stones, it is also possible to machine shape changes at selected positions about the circumference and longitudinal axis of the bore. By individual honing stones that can be independently fed, especially by means of short honing stones, very small axial longitudinal sections of the bore surface 4-01 that characterize a change segment can be machined. In this connection—in analogy to the conditions about the circumference of the surface to be machined—it is advantageous when the length of the honing stones is smaller than the longitudinal extension of the shape change.

A honing stone can also be mounted on a support bar with several wedge surfaces as shown in the example of the guide bar 2-04 and its arrangement on the support bar 2-03.

Sensors for diameter measurement and shape measurement are not illustrated. Integrated dimension, position and shape measuring devices determine the quality either in process or post process in a separate measuring stroke (compare in this connection also the force sensor 130 in FIGS. 7 and 9).

FIG. 4*a* shows the operation of the linear drive 1-06 for a feed force F within a depression 11. The feed force F in this connection, as shown in the diagram of FIG. 4*a* at the top, has always, this means independent of the feed stroke s, a constant value. For each pass within this shape change segment the momentarily existing depression 11' is thus expanded by an amount ds that is also constant.

Another operating mode of the linear drive 1-06 is illustrated in FIG. 4*b*. An appropriate power admission is controlled such that the feed force F with increasing feed stroke s decreases (compare diagram) so that at the beginning of machining for each pass a relative large depression 11' is produced. With increasing number of passes in the area of the depression, the radial feed stroke ds and thus also the radial material removal ds becomes smaller.

Figure 5:
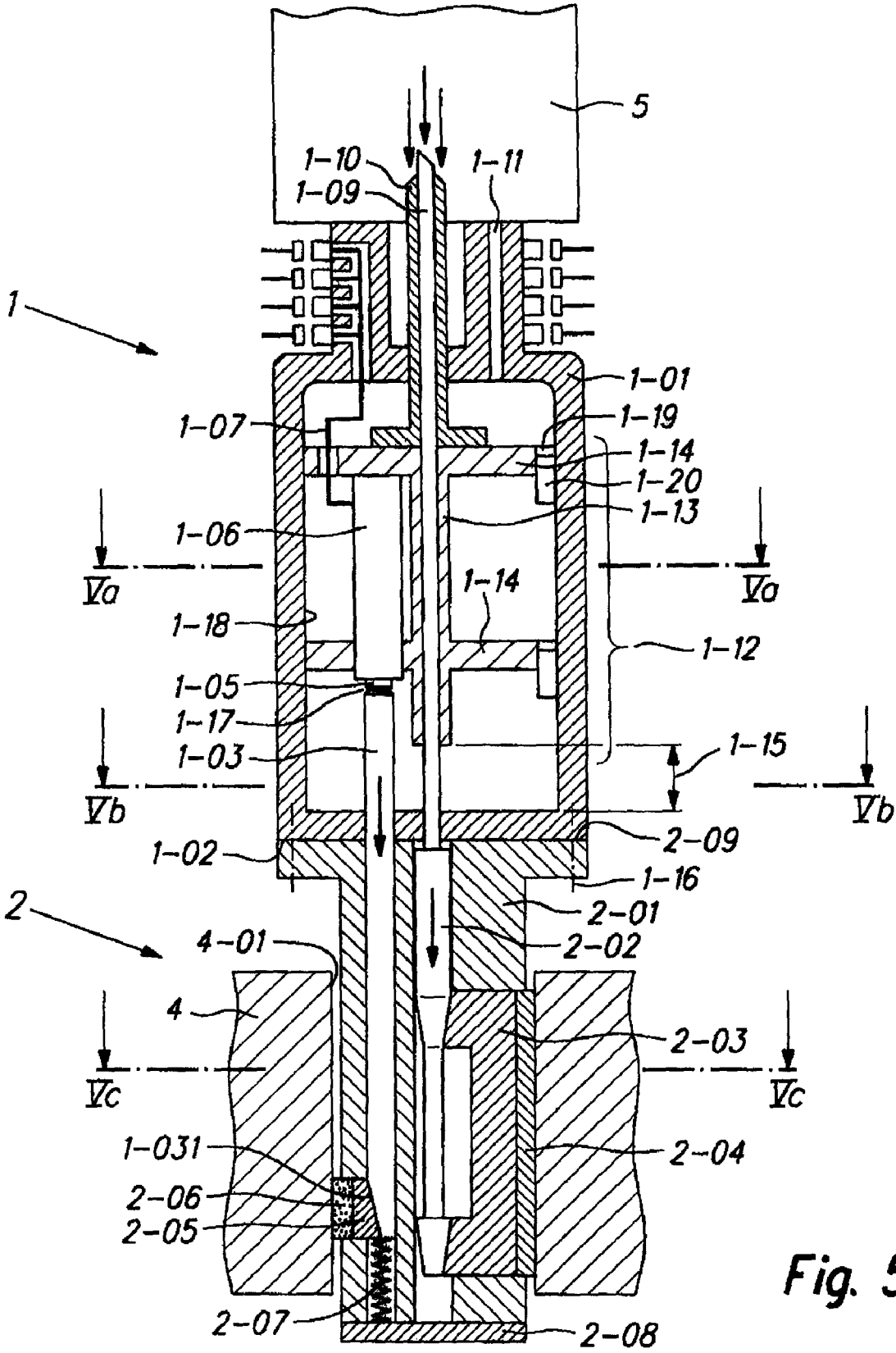
FIG. 5 a second embodiment.

The embodiment according to FIG. 5 differs from that of FIG. 3 by an improved guiding action of the tool receiving unit 1 in the housing 1-01. This is ensured in that the linear drive 1-06 rests directly against the upper flange 1-14 of the support 1-13 and because the force transmission from the plunger 1-05 of the linear drive 1-06 onto the feed rod 1-03 is realized by a low-friction and low-wear hard metal plate 1-17. The stroke of the coarse feed action by means of the feed tube 1-10 is indicated at 1-15. The stroke of the fine feed action is determined by the linear drive 1-06.

The two flanges 1-14 of the support 1-13 are relatively thick and with their outer dimensions are matched such to the cylindrical inner surface 1-18 of the housing 1-01 that the support 1-13 is safely and without play guided in the housing 1-01 during its up and down movement. In this way, the guided surface is more stable. The inner surface 1-18 is accordingly machined as a tribologically loaded guide surface.

Moreover, the flanges 1-14 in the housing 1-03 are received so as not to rotate. For this purpose, they have grooves 1-19 into which as an anti-rotation device a feather key 1-20 (or a pin) projects radially so that a longitudinal movement of the flanges 1-14 but not a rotational movement is possible. This arrangement thus provides an anti-rotation device for the support 1-13 in the housing 1-01.

Figure 5A:
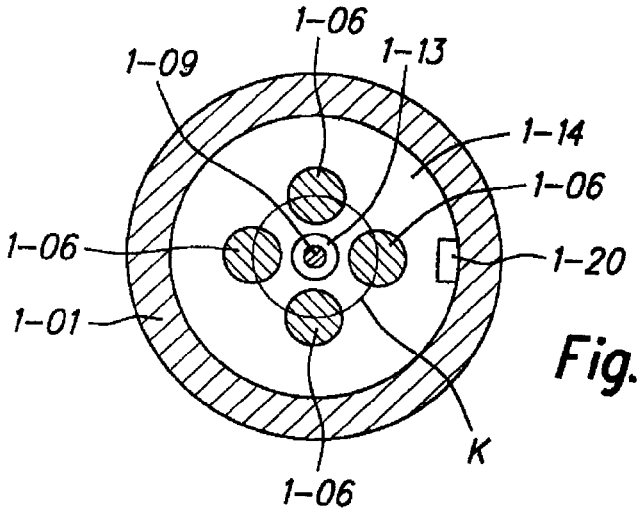
FIG. 5*a* a view in the direction of arrows Va-Va in FIG. 6.
Figure 5B:
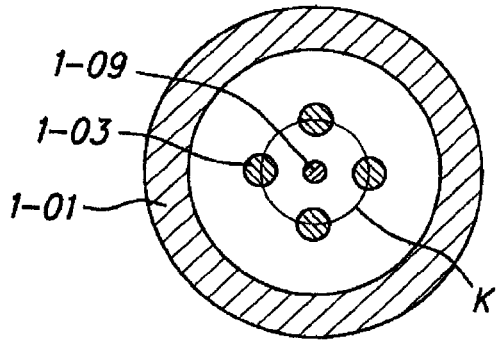
FIG. 5*b* a view in the direction of arrows Vb-Vb in FIG. 6.
Figure 5C:
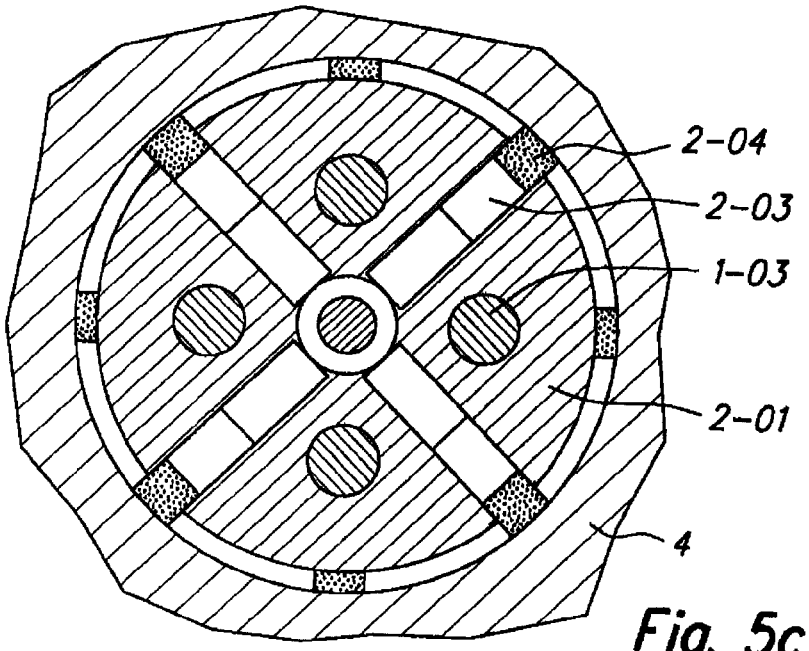
FIG. 5*c* a view in the direction of arrows Vc-Vc in FIG. 6.

As can be seen in FIG. 5*a*, in the embodiment according to FIGS. 5, 5*a*-5*c* along the circumference (circular line K) four linear drives 1-06 are provided. They are positioned, as is also shown for the linear drive 1-06 in FIG. 5, on the bottom side of the upper flange 1-14 of the support 1-13. The plungers 1-05 arranged at the lower end of the linear drive 1-06 are embodied to be as short as possible so that possibly occurring bending moments that may act on the linear drive are as minimal as possible. The hard metal plate 1-17 ensures also a high wear safety for permanent pulsed operation.

Figure 7:
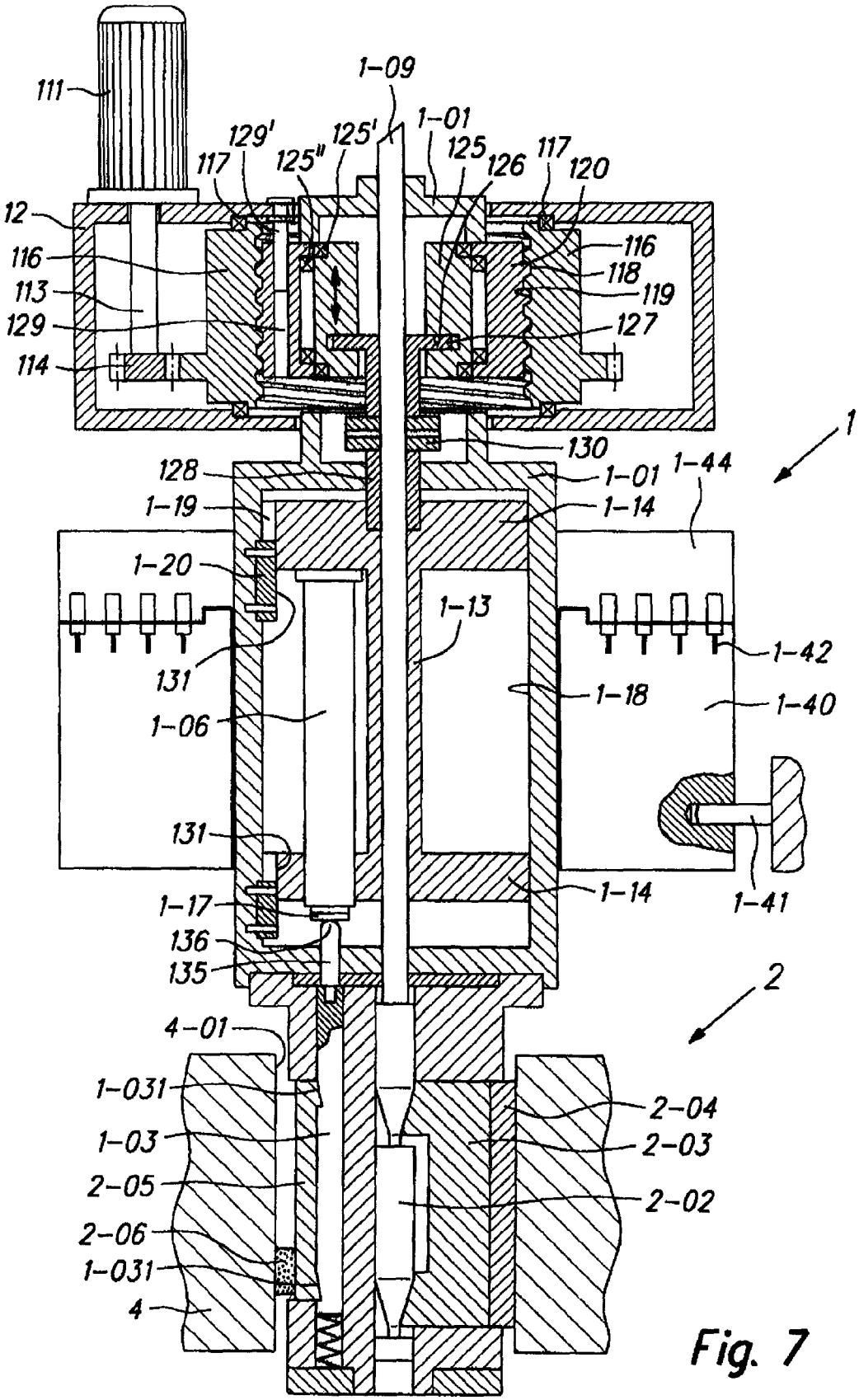
FIG. 7 a fourth embodiment.

In order to achieve a transmission, that is as much as possible free of transverse forces in some way, of the feed force through the plungers 1-05 of the hard metal plate 1-17 onto the feed rod 1-03, the end face of the feed rod 1-03 is embodied as a rounded end so that only a point contact occurs (see in this connection also the explanations in connection with the description of the embodiment of FIG. 7).

The linear drives 1-06 can be operated by a force measuring sensor in a force-controlled way, by means of a strain gauge in a stroke-controlled way, or in an uncontrolled operation (the feed stroke is proportional to the applied voltage).

Figure 6:
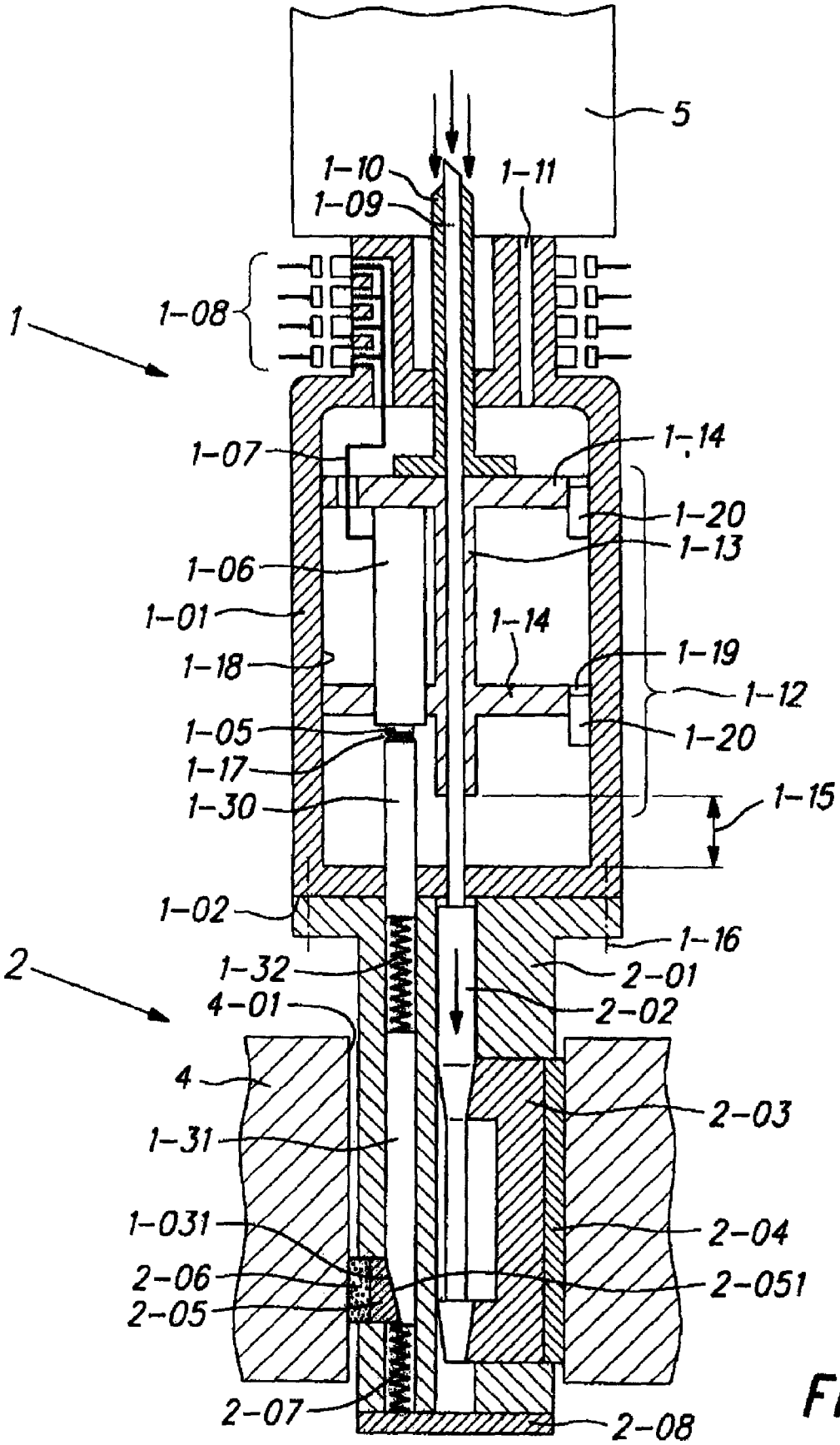
FIG. 6 a third embodiment.

In the embodiment according to FIG. 6 the feed rod that in the afore described embodiments was identified by reference numeral 1-03, is now embodied in the form of two feed rod sections 1-30 and 1-31 that are embodied separate from one another and are operatively connected with one another by means of a pressure spring 1-32. In this way, the linear drive 1-06 is active as a force transmission and not directly as an actuator. The feed tube 1-10 is embodied as shown in FIG. 5. It moves downwardly and pushes the linear drives 1-06 by means of the bottom side of the upper flange 1-14 downwardly and acts thus by means of the feed rod section 1-30 onto the pressure spring 1-32 onto the feed rod section 1-31. In this way, the honing stones 2-05 are pressed against the cylindrical inner surface of a bore the force of the pressure spring 1-32 as is appropriate in particular for smoothing of a pre-machined shape.

The embodiment according FIG. 7 provides suitable measures in order to compensate counterforces that are generated upon activation of the linear drive 1-06 by pressing the honing stones 2-05 against the inner surface 4-01 of a bore in the workpiece 4 that is to be machined and, for example, in the embodiment according to FIG. 5, have the tendency to push the feed rod 1-10 in the upward direction. This is realized by a blocking device.

The blocking device is formed in that the feed action of the honing stones 2-05 no longer is realized by a feed tube that is directly actuated by the machine (as the feed tube 1-10 according to FIGS. 3, 5 and 6) but by a feed motor 111 that is arranged in a housing 112 fixedly mounted in the machine. This housing 112 that does not rotate compensates the aforementioned counterforces. It surrounds the upper part of rotating housing 1-01 of the tool receiving unit 1 that projects into the housing 112. The feed motor 111 rotates by means of a shaft 113 a gear 114 that meshes with a ring gear 115 on a feed nut 116. The feed nut is supported by means of a bearing 117 in the housing 112. The feed nut 116 is provided at the inner side with a trapezoid thread 118 that meshes with a trapezoid thread 119 located on the exterior side of the spindle nut 120. This means that the drive of the feed motor 111 rotates the feed nut 108 and, by means of gear-like meshing of the two trapezoid threads 118 and 119, the spindle nut 120, as indicated by the illustrated arrow, is moved in the axial direction. The spindle nut 120 is secured by means of pin 129' that is arranged on the housing 112 and engages the bore 129 so as not to rotate together with the spindle nut 120.

In the spindle nut 120 there is a feed sleeve 125 rotatably supported by means of a radial bearing 125' and an axial bearing 125". The feed sleeve 125 is provided on the interior with an annular nut 126 in which a flange 127 of a feed tube 128 is received that is an integral component of the feed tube 128. The feed tube 128 acts—with interposition of a force measuring sensor 130—on the upper flange 1-14 of the support 113. The flanges 1-14 are secured in the housing 1-03 against rotation by groove-and-feather key connections 131.

The force measuring sensor 130 serves for readjustment of the coarse feed action that is needed with increasing removal by fine feed. The honing stones are therefore applied always at constant force and are superposed by the locally acting feed force of the fine feed.

When by controlling the feed motor 111 the support 1-13 is moved, the lower surface of the upper flange 1-14 presses on the linear drives 1-06, of which only one is shown, of which however, in analogy to FIG. 5*a*, four may be arranged, for example, on the circle K about the axis of the arrangement. The lower end of the linear drive 1-06 acts by means of a hard metal plate 1-17 without transverse forces onto the rounded end 136 of a feed pin 135 of the feed rod 1-03 which is provided with two slanted feed surfaces 1-31 that upon the axial feed action interact with correspondingly designed slanted surfaces of a honing stone 2-05, push them in radial direction outwardly, and thus force the cutting means coating 2-06 arranged thereon to engage the inner surface 4-01 of the workpiece 4 wherein, as illustrated, the coarse feed action is realized by the feed motor 111 and the fine feed action is realized by the linear drive 1-06. The counterforces that are generated upon pressing the honing stones with the cutting coating against the inner surface of the bore 4-01 of the workpiece are compensated by the housing 112 that is arranged on the machine because the two meshing threads 118 and 119 are designed to be self locking. As a result of the stable guiding action of the support 1-13 in the housing 1-01 and the force transmission that is embodied otherwise free of transverse forces, no deformations of the components of the feed mechanism will happen, in particular no bending moments will occur.

FIG. 7 also shows that the housing 1-01 of the tool receiving unit is surrounded by a device 1-40 that, as schematically illustrated at 1-41, is arrange by means of an anti-rotation device on the machine frame in a rotating fashion and is provided with sliprings 1-42 that provide an electrical connection to the sliprings 1-43 that are arranged on the component 1-44 that rotates together with the tool receiving unit. By means of this slipring connection the electrical control and energy supply of the linear drives 1-06 is realized.

The other components that can be seen in FIG. 7 have the same function as in the other embodiments.

Figure 8:
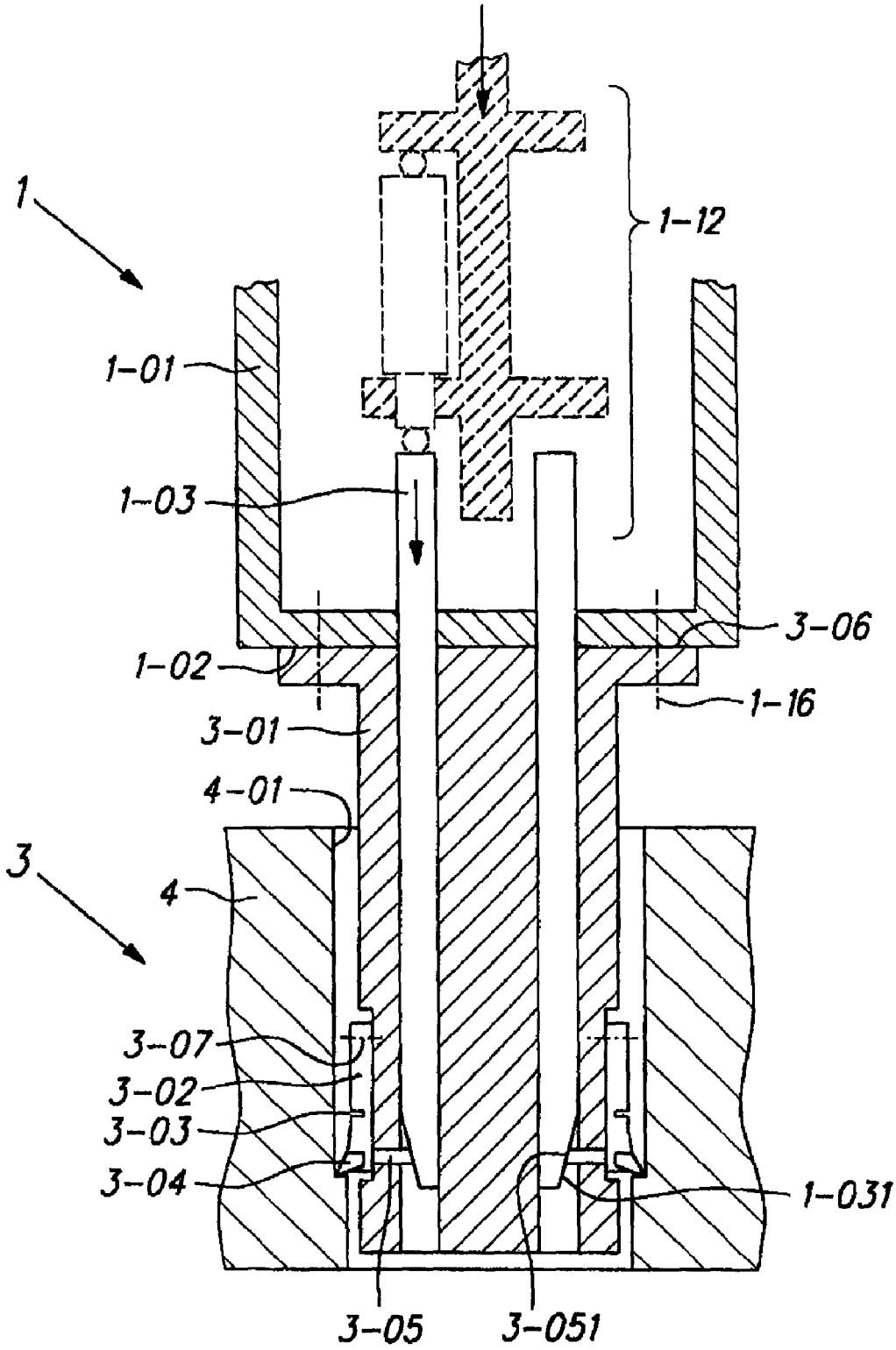
FIG. 8 a fifth embodiment.

FIG. 8 shows a further embodiment in which the tool unit is configured as a fine drilling tool 3. On the end face 1-02 of the housing 1-01 of the tool receiving unit 1 the end face 3-06 of a shape drilling tool 3 is resting. The means for fine feed action 1-12 with energy supply and constructive configuration corresponds substantially to those of the embodiment according to FIG. 3. The feed rods 1-03 however actuate in this case a shape drilling tool, i.e., a cutting means with defined cutting geometry. On the wedge-shaped feed surface 1-031 a feed pin 3-05 with its feed surface 3-051 is resting. Upon axial displacement of the feed rod 1-03 the feed pin 3-05 is forced outwardly in radial direction. When doing so, it impinges on the cutting plate holder 3-02 that is screw-connected to the tool body 3-01 at 3-07 and whose bottom section as a result of material removal in the form of the bending notch 3-03 can be elastically bent outwardly and thus feed the cutting plate 3-4 with its tip radially against the inner surface 4-01 of the workpiece 4.

The preadjustment of the cutting edges is realized in analogy to the coarse adjustment as in the afore described embodiments by a central force which entrains the fine feed action 1-12 downwardly and thus moves the cutting plates 3-04 radially into the machining position. The individual local shape change segments are then again generated in that for each cutting edge independently a fine feed action is realized which is to be generated at the location where the cutting plate is currently located.

With the feed action that is available through the machine, in particular the double feed action for machining tools and guide bars, it is also possible that for a downward stroke a roughing action and for an upward stroke a finish-machining action can be carried out. During both steps the dynamic fine feed action may be activated.

Figure 9:
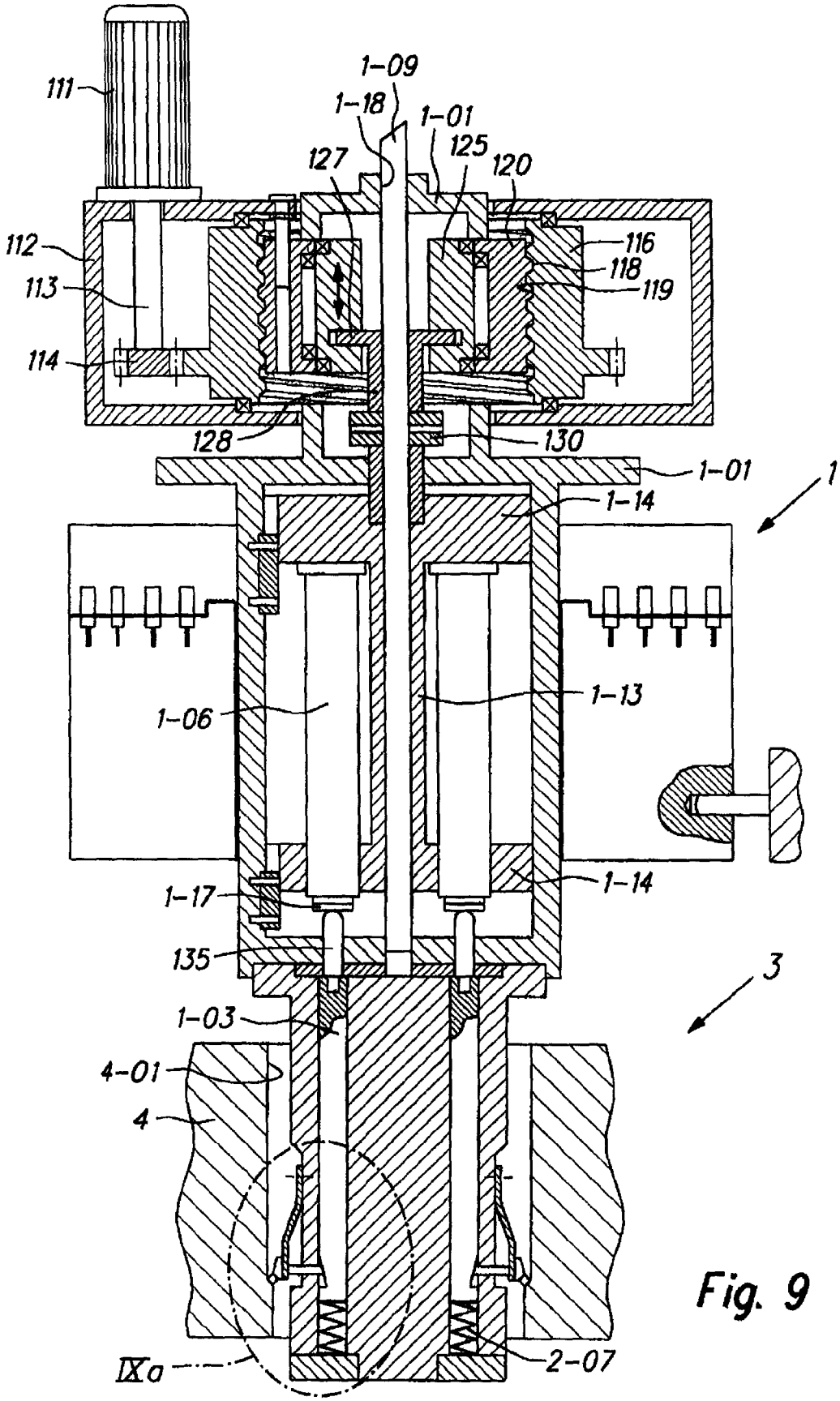
FIG. 9 a sixth embodiment.
Figure 9A:
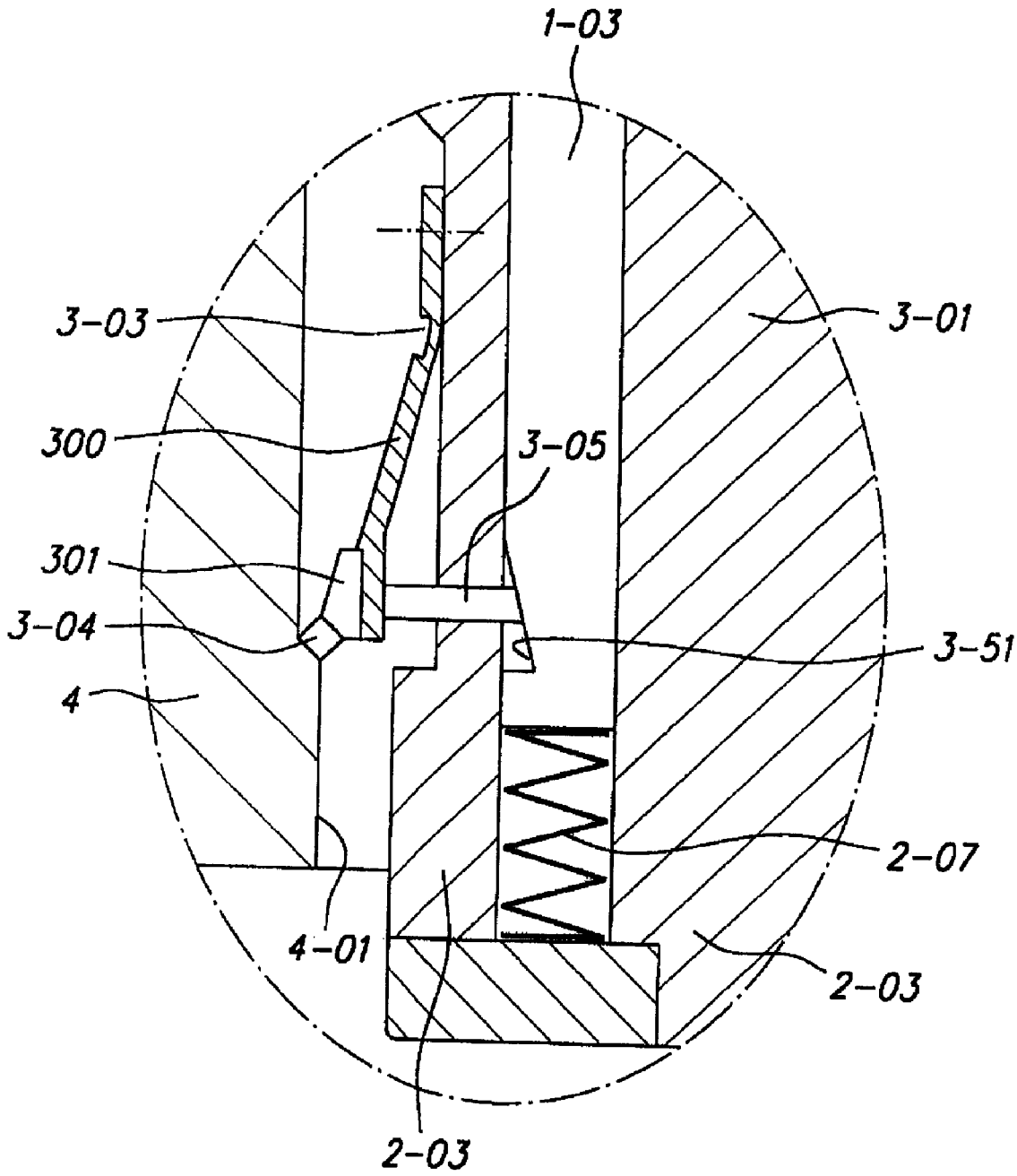
FIG. 9*a* the detail shown in FIG. 9 at IXa in an enlarged illustration.

The embodiment according to FIG. 9 and FIG. 9*a* is substantially designed like that of FIG. 7 but with the condition that again—as in FIG. 8—a tool receiving unit is provided that receives as a shape drilling tool.

As already described above, here also the upper rotating part of the tool, in the present case of the shape drilling tool 3 that is comprised of the feed rod 1-10, the feed sleeve 125, and the feed tube 128, is surrounded by the housing 112 that is not rotating, on which a feed motor 111 is arranged that, in the above described way, axially moves the spindle nut 120, as indicated by the illustrated double arrow. In this way, also the feed tube 128, the linear drive 1-06 and by means of the hard metal plate 1-017 the feed pin or the feed pins 1-35 as well as the feed rod 1-03 are moved against the force of the restoring spring 2-07. On the lower end of the feed rod 1-03 a slanted feed surface 3-51 (see FIG. 9*a*) is provided, respectively, that forces a fine drill bit cutting edge 301 attached on a cutting edge holder 301 in radial direction outwardly and thus against the bore surface 4-01 in the workpiece 4. The cutting edge holder 300 is fixedly connected to the tool body 3-01, for example, screw-connected thereto. The cutting edges 3-04 can be arranged radially and/or axially in various positions.

Both embodiments describe a tool for producing depressions 11 and constrictions 22 in a bore. For a tool receiving unit with integrated linear direct drives that is arranged on the machine only the tool unit must be matched to the corresponding process.

The invention claimed is:

1. A machine for producing a non-cylindrical bore surface, the machine comprising:

a machine spindle that is reciprocatingly movable and driven in rotation;

a tool receiving unit disposed on said machine spindle;

a tool unit that is exchangeably connected to said tool receiving unit;

at least one machining tool received in said tool unit;

feed means transmitting a first feed movement onto said at least one machining tool;

deflecting means that deflect said first feed movement such that said first feed movement feeds said at least one machining tool radially against a bore surface to be machined;

a means for fine feed arranged in said tool receiving unit, wherein said first feed movement of said feed means is superposed by a second feed movement of said means for fine feed;

said means for fine feed comprises a first linear drive that acts axis-parallel, wherein said first linear drive comprises an actuator that actuates a feed rod, wherein said feed rod is arranged together with said at least one machining tool and said deflecting means in said tool unit.

2. The machine according to claim 1, wherein said first linear drive comprises a piezoelectric element.

3. The machine according to claim 1, comprising sliprings disposed on the tool receiving unit for transmitting control signals and/or electric energy to said linear drive.

4. The machine according to claim 1, comprising contactless transmission means disposed on the tool receiving unit for transmitting control signals and/or electric energy to said first linear drive.

5. The machine according to claim 1, comprising a support, wherein said first linear drive is arranged on said support and wherein said feed means act on said support.

6. The machine according to claim 1, wherein said second feed movement is transmitted onto said feed rod by transmission means that transmit tension and/or pressure without play and free of transverse forces.

7. The machine according to claim 1, comprising a second linear drive effecting or assisting a restoring action of said means for fine feed.

8. The machine according to claim 1, wherein said at least one machining tool is a honing stone.

9. The machine according to claim 1, wherein the honing stone has a length in an axial direction of the bore to be machined that is shorter than a shape change to be achieved in said axial direction of the bore.

10. The machine according to claim 1, wherein said at least one machining tool is a shape drilling tool.

11. The machine according to claim 1, wherein said feed rod projects into said tool receiving unit.

12. The machine according to claim 1, further comprising guide bares arranged in said tool unit in addition to said at least one machining tool, wherein said guide bars are radially movable and placeable against the bore surface.

13. The machine according to claim 1, wherein said first feed movement is used as a coarse feed action onto which is superposed a fine feed action provided by said first linear drive.

14. The machine according to claim 1, wherein said feed rod onto which said actuator of said first linear drive is acting is made from a material of low density.

15. The machine according to claim 1, further comprising:

a support, wherein said first linear drive is arranged on said support;

a feed tube acting on said support, wherein said support for producing a coarse feed action is axially moved by said feed tube.

16. The machine according to claim 15, wherein said tool receiving unit comprises a housing, wherein said support has an upper flange and a lower flange each having a circumferentially extending cylindrical lateral surface, wherein said upper and lower flanges are guided rotationally secured on a cylindrical inner surface of said housing of said tool receiving unit by said circumferentially extending cylindrical lateral surfaces.

17. The machine according to claim 16, further comprising a blocking device that prevents by means of a counterforce generated upon feeding of said at least one machining tool against the bore surface said feed means are moved in a direction opposite to said first feed direction.

18. The machine according to claim 17, wherein said blocking device is comprises:

a non-rotating housing;

a feed nut arranged in said non-rotating housing;

a feed motor acting on said feed nut so as to rotate said feed nut;

a spindle nut;

a feed sleeve that is received rotatably in said spindle nut;

a self-locking gear connection connected between said feed nut and said spindle nut;

wherein said spindle nut is axially moved by said feed nut through said self-locking gear connection; and wherein said feed rod is received in said feed sleeve.

19. The machine according to claim 18, wherein said feed tube is provided with a flange that is received in said feed sleeve.

20. The machine according to claim 15, wherein in said feed tube a force measuring sensor for a controlled readjustment of a coarse feed action is arranged.

21. The machine according to claim 1, wherein in said feed means a force measuring sensor for a controlled readjustment of a coarse feed action is arranged.

22. The machine according to claim 1, further comprising a hard metal plate and a feed pin with a rounded end, wherein between said first linear drive and said feed rod for said at least one machining tool said hard metal plate and said feed pin are intermediately positioned such that said hard metal plate acts on said rounded end of said feed pin that is coupled in an axial direction to said feed rod.

23. A tool unit for a machine according to claim 1, wherein in the tool unit radially movable machining tools, axis-parallel feed rods, and deflecting means that deflect an axial feed movement into a radial feed movement are arranged, but not means for a coarse feed action.

* * * * *